US008844434B2

(12) United States Patent
Barnes et al.

(10) Patent No.: US 8,844,434 B2
(45) Date of Patent: Sep. 30, 2014

(54) MACHINE FOR BINDING REINFORCEMENT BARS

(75) Inventors: Graham Frank Barnes, Surrey (GB); Ian David Coles, West Sussex (GB)

(73) Assignee: Tymatic Limited, Mayfield, East Sussex (GB)

( * ) Notice: Subject to any disclaimer, the term of this patent is extended or adjusted under 35 U.S.C. 154(b) by 28 days.

(21) Appl. No.: 13/320,221

(22) PCT Filed: May 11, 2010

(86) PCT No.: PCT/GB2010/000942

§ 371 (c)(1),
(2), (4) Date: Jan. 23, 2012

(87) PCT Pub. No.: WO2010/130991

PCT Pub. Date: Nov. 18, 2010

(65) Prior Publication Data

US 2012/0111206 A1 May 10, 2012
US 2013/0125769 A9 May 23, 2013

(30) Foreign Application Priority Data

May 11, 2009 (GB) ..... 0908106.8

(51) Int. Cl.
*B65B 13/28* (2006.01)
*B21F 15/04* (2006.01)
*E04G 21/12* (2006.01)

(52) U.S. Cl.
CPC ..... *E04G 21/122* (2013.01)
USPC ..... 100/31; 140/93.6; 140/119

(58) Field of Classification Search
USPC ..... 100/31; 140/93.6, 119
See application file for complete search history.

(56) References Cited

U.S. PATENT DOCUMENTS

| | | | | |
|---|---|---|---|---|
| 1,809,566 | A | 6/1931 | Ott et al. | |
| 2,919,894 | A | 1/1960 | Hepler | |
| 3,208,885 | A | 9/1965 | Müller et al. | |
| 3,632,989 | A | 1/1972 | Kasischke | |
| 3,718,798 | A | 2/1973 | Randolph et al. | |
| 4,508,030 | A | 4/1985 | Grenon | |
| 4,542,773 | A | 9/1985 | Lafon | |
| 4,953,598 | A | 9/1990 | McCavey | |
| 5,311,721 | A * | 5/1994 | Urchaga | 53/118 |

(Continued)

FOREIGN PATENT DOCUMENTS

| | | |
|---|---|---|
| CH | 648085 | 2/1985 |
| DE | 1511828 | 9/1966 |

(Continued)

*Primary Examiner* — Jimmy T. Nguyen
(74) *Attorney, Agent, or Firm* — Knobbe, Martens, Olson & Bear, LLP

(57) ABSTRACT

A machine for forming a two-stage wire tie around a pair of bars to bind the bars together. The machine comprises an arrangement for passing the wire in a loop around the bars and a twisting head for twisting the ends of the loop together. The twisting head comprises an arrangement for gripping the ends of the wire and a tie plate through which the ends of the wire pass, and the head is resiliently mounted relative to the bars so as to allow the tie plate to move through a predetermined amount of travel towards the bars, to thereby define the length of a first stage of the tie. The machine is adapted thereafter to release the ends of the wire and continue twisting these to form a second stage of the tie.

15 Claims, 6 Drawing Sheets

(56) References Cited

U.S. PATENT DOCUMENTS

| | | | | |
|---|---|---|---|---|
| 5,778,945 | A * | 7/1998 | Crowther | 140/115 |
| 5,947,166 | A | 9/1999 | Doyle et al. | |
| 7,051,650 | B2 * | 5/2006 | Kusakari et al. | 100/31 |
| 7,140,400 | B2 | 11/2006 | Yokochi et al. | |
| 7,143,792 | B2 | 12/2006 | Ishikawa et al. | |
| 7,275,567 | B2 | 10/2007 | Ishii et al. | |
| 2006/0157139 | A1 | 7/2006 | Hoyaukin | |
| 2011/0155277 | A1 | 6/2011 | Coles et al. | |

FOREIGN PATENT DOCUMENTS

| | | | |
|---|---|---|---|
| DE | 19806995 | | 9/1999 |
| EP | 1 557 359 | A1 | 7/2005 |
| FR | 1576602 | | 6/1969 |
| FR | 2552364 | A1 | 3/1985 |
| WO | WO 2004/083559 | | 9/2004 |
| WO | WO 2007/042785 | A2 | 4/2007 |

* cited by examiner

MACHINE FOR BINDING REINFORCEMENT BARS

BACKGROUND OF THE INVENTION

1. Field of the Invention

This application relates to machines for binding together concrete reinforcing bars using wire ties.

One such machine is described in WO 2004/083559.

2. Description of the Related Art

A problem with known machines has been identified by the Applicant. The Applicant has noticed is that it is common practice when in actual use on building sites to use the jaws of machines of the type disclosed in WO 2004/083559, to knock flat the twisted ends of the wire once the twisting operation has been completed in order to prevent things snagging on the twisted wire, which may have sharp ends. However, such machines are not designed for this purpose it has been observed that repeated knocks to the lower jaws from such use and other rough handling can quickly cause them to become distorted or misaligned. Since the jaws are essential for guiding the wire in the correct path, any such misalignment or distortion can prevent the machine operating properly.

Another problem identified by the Applicant with known machines is that the ties produced can vary in size and strength.

SUMMARY OF THE INVENTION

The present application aims to reduce these problems and provides a machine for forming a two-stage wire tie around a pair of bars to bind the bars together, said machine comprising means for passing said wire in a loop around the bars and a twisting head for twisting the ends of said loop together, said twisting head comprising means for gripping the ends of the wire and a tie plate through which the ends of the wire pass, and said head being resiliently mounted relative to the bars so as to allow the tie plate to move through a predetermined amount of travel towards the bars, to thereby define the length of a first stage of the tie, the machine being adapted thereafter to release the ends of the wire and continue twisting these to form a second stage of the tie.

Thus it may be seen that the length of the first stage of the tie is defined by the movement travel of the tie plate against its resilient mounting. This is carried out under tension and ensures a very tight binding. Once the predetermined length of binding has been carried out, the ends are released but continue to be wrapped around each other which avoids sharp ends which could snag.

In some embodiments the centre of the tie plate, which contacts the end of the tie, is flat. In other embodiments it comprises one or more protrusions.

In some embodiments the tie plate is allowed to bounce back to its initial position, under the action of the resilient mounting, when the ends of the wire are released. In these embodiments the second stage of tie will be formed above the first.

In other embodiments the machine comprises a latch to hold the tie plate at the end of its travel. This prevents it from bouncing back as above. In these embodiments the second stage of tie will be formed around the first stage. Where the tie plat is flat, the second stage of the tie will also tend to be approximately flat.

The latch could just be at the end of the travel or could be a ratchet mechanism throughout some or all of the travel.

The latch/ratchet could be released manually or automatically at an appropriate point after the tie is finished.

The means for gripping the ends of the wire could grip the wire with a gripping force that is adjusted to allow the wire to slip out when the tie plate reaches the end of its travel. Preferably the gripping means clamps the wire securely and thus requires releasing when the tie plate reaches the end of its travel.

Preferably the tie plate moves towards the bars by approximately 1 mm for each full rotation of the twisting head.

Preferably the machine is configured to be placed on a reinforcement bar with the tie plate initially less than 20 mm away from the bar, more preferably less than 15 mm away.

Preferably the twisting head comprises at least one clamping member. Preferably the twisting head comprises two clamping members, one for each end of the wire.

Preferably the or each clamping member can apply a clamping force which can hold the wire securely when the tension in the wire is at least between 250 and 350 Newtons.

Preferably the machine is adapted to detect when the tie plate has reached the end of its travel. This could be done using a suitable switch or other sensor. Alternatively it could be done by measuring a change of torque on the motor driving the twisting head.

BRIEF DESCRIPTION OF THE DRAWINGS

Certain preferred embodiments of the invention will now be described, by way of example only, with reference to the accompanying drawings in which.

DETAILED DESCRIPTION OF THE PREFERRED EMBODIMENT

Figure 1:
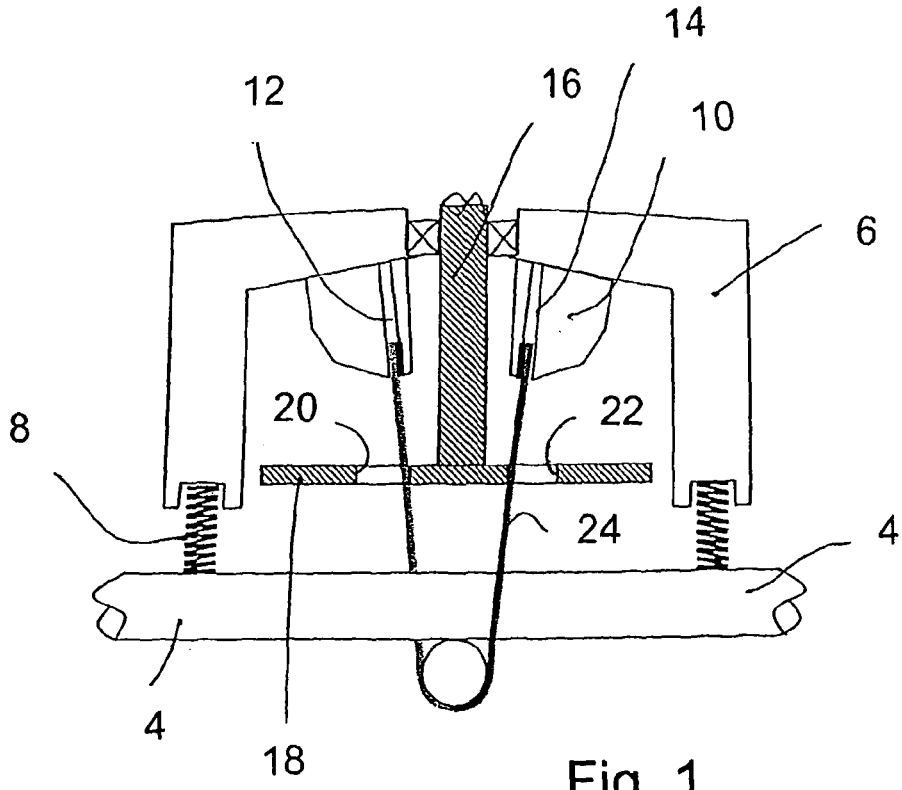
FIG. 1 is a schematic view of a machine embodying the invention above a pair of crossed bars prior to a twisting operation being initiated.

In all the Figures there is shown a wire tying machine 2 placed on top of a pair of reinforcement bars 4 which cross at right angles to each other. The machine comprises a static outer housing 4 with compression springs 8 on its lower face. This machine rests on the uppermost reinforcement bar 4 on the springs 8. The arrangement of the springs in the Figures is intended to be indicative only of a resilient mounting, the actual form of the resilient element(s) could be very different and could be provided elsewhere on the machine. All that is needed is that there is some resilient component between the part of the machine that rests on the reinforcement bar 4 and the twisting head (described below).

The twisting head comprises an annular main body 10 with wire channels 12, 14 passing through it. In each channel 12, 14 is a clamping member, although these have been omitted for clarity from this schematic diagram. Passing through the middle of the main body 10 of the twisting head is a spindle 16 which supports a flat circular tie plate 18 at its end. The tie plate 18 has slots or apertures 20, 22 through which the two ends of the wire 24 pass.

In operation a length of wire 24 is drawn from a spool, fed out through one wire channel 12 to form a loop around the intersection of the reinforcement bars 4 and is received back into the other wire channel 14. The wire is then clamped at its end in the second channel 14 and retracted to pull the loop tight around the underneath of the intersection. It will be seen from FIG. 1 that the wire is pulled almost vertical. Once it has been pulled tight the other clamping member is made to engage the wire in the first channel 12. The wire is then cut—e.g. by shearing it as the head 10 begins to rotate. Thus far the operation is conventional and is described in general terms in WO 2004/083559. No detailed description is therefore given here.

Figure 2:
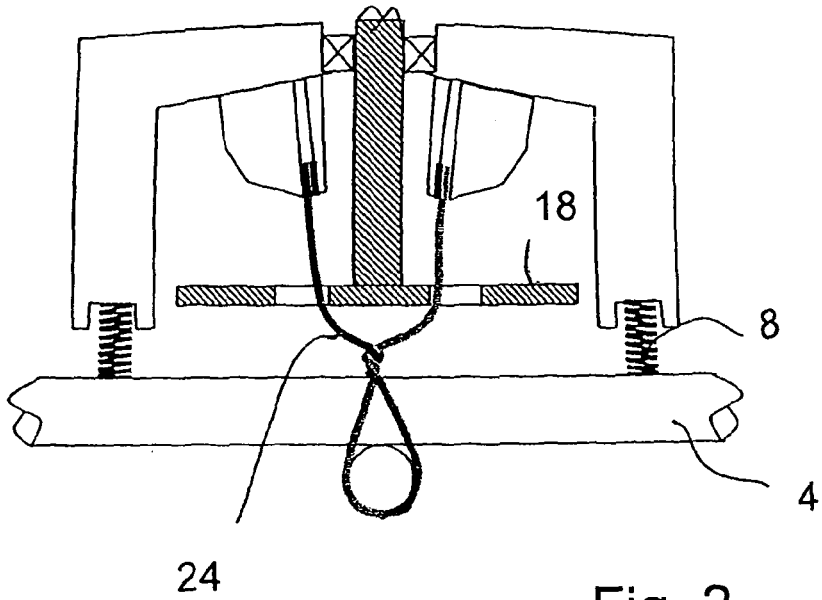
FIGS. 2 to 7 are views similar to FIG. 1 at various stages of tying with a machine according to a first embodiment.

FIG. 1 shows the wire 24 before twisting. As the wire is twisted more and more, because its ends are securely clamped in the respective channels 12, 14, the whole machine is pulled down towards the bars 4 compressing the springs 8. This can be seen by comparing FIG. 2 with FIG. 1. The tie plate 18 starts off for example less than 15 mm away from the uppermost bar 4 and is moved towards it approximately 1 mm for each full turn.

Figure 3:
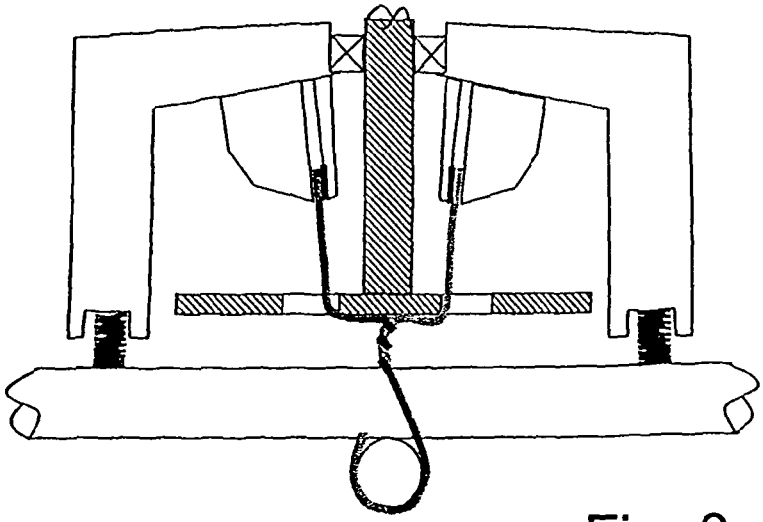

Twisting continues until the springs 8 are fully compressed at which point tie plate 18 has reached the end of its travel and is now for example less than 10 mm from the uppermost bar 4. This is shown in FIG. 3. This Figure also shows the tied section of the wire 26 is touching the underside of the tie plate 18. The tie plate thus defines the length of the first tie stage.

Figure 4:
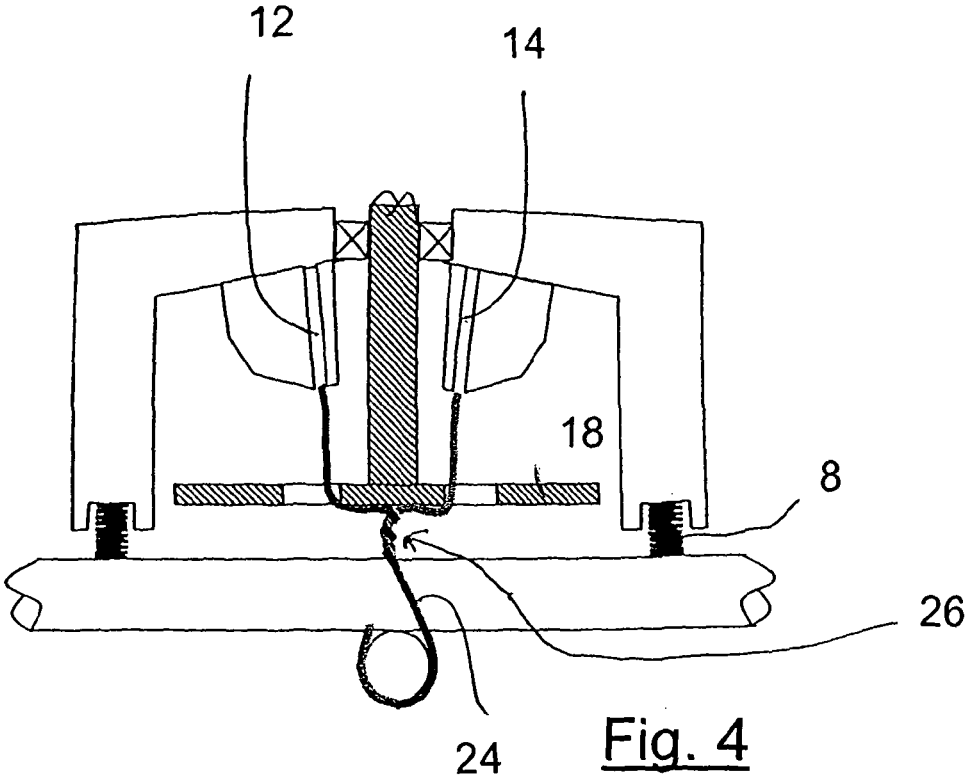

When this point is reached the torque on the motor driving the head 10, 16 increases rapidly which is sensed by the machine and prompts the clamp members to be released so allowing the ends of the wire 24 to come out of the channels 12, 14. This is shown in FIG. 4. However a ratchet mechanism (not shown) prevents the springs 8 from returning to their rest position and the tie plate 18 therefore remains at the end of its travel.

Figure 5:
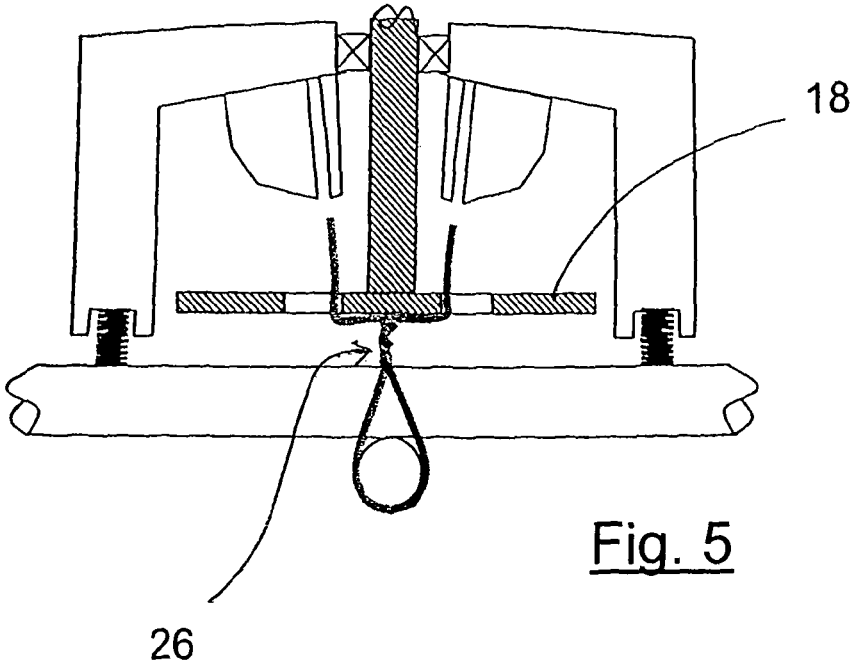
Figure 6:
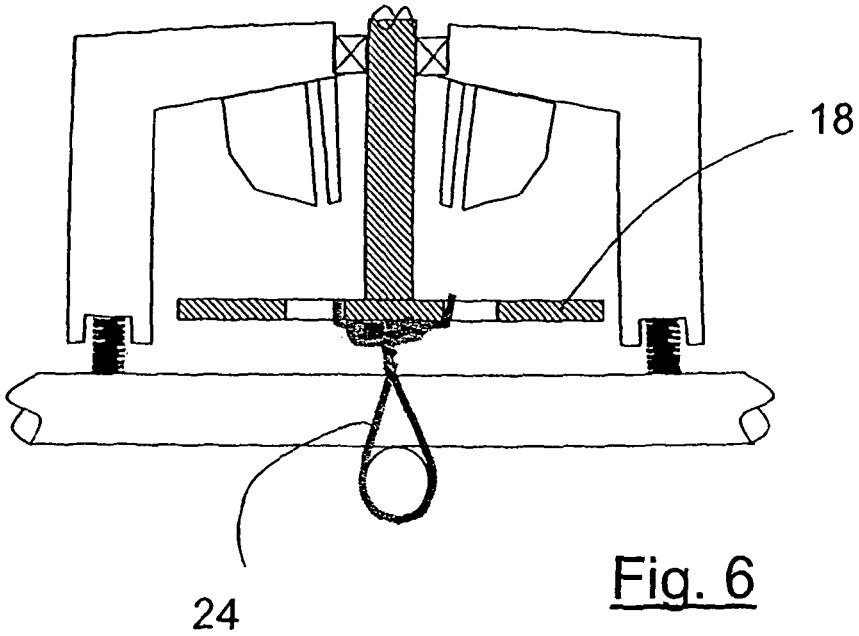
Figure 7:
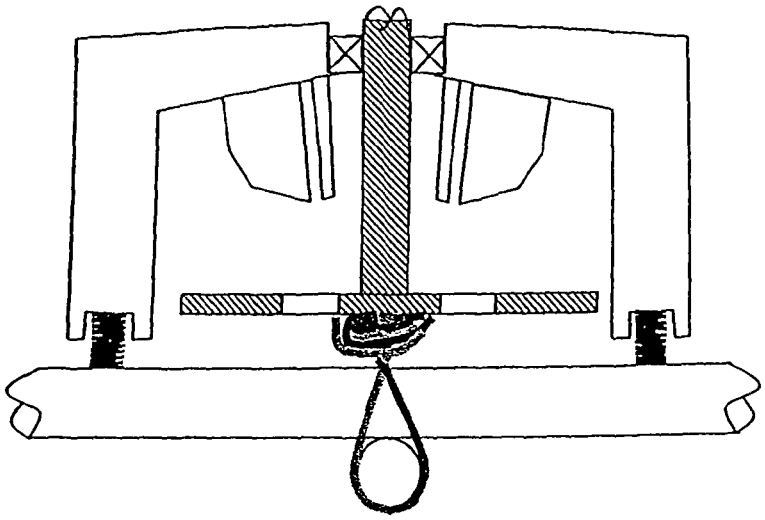

With the ends of the wire 24 released, the machine commences a second stage of tying shown in FIGS. 5 and 6. In this stage the wire 24 is not under tension and the ends are made to wrap around the outside of the first stage of the tie 26. The tie plate 18 forces the wrapping to progress downwards towards the bars 4. The completed tie is shown in FIG. 7. After completion of the tie the machine is returned ready to use to tie another tie. This involves releasing the latch or ratchet which can be done manually or automatically.

Figure 8:
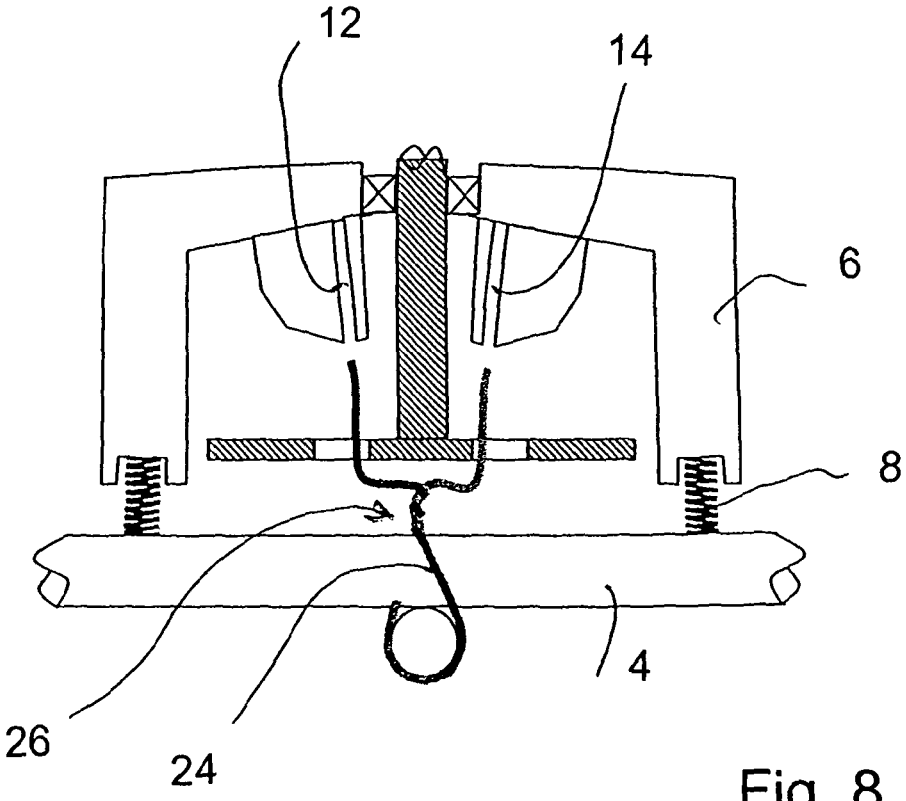
FIGS. 8 to 10 are views similar to FIG. 1 showing the different operation of a second embodiment.

Another embodiment will be described with reference to FIGS. 8 to 10. In this embodiment the operation is the same as the first up to release of the ends of the wire 24 shown in FIG. 4. In this embodiment there is no ratchet or latch holding the springs 8 compressed and thus when the wire clamps are released and the ends of the wire exit the channels 12, 14, the springs 8 return to their original shape as can be seen in FIG. 8 and the housing 6 'bounces back' to its original position.

Figure 9:
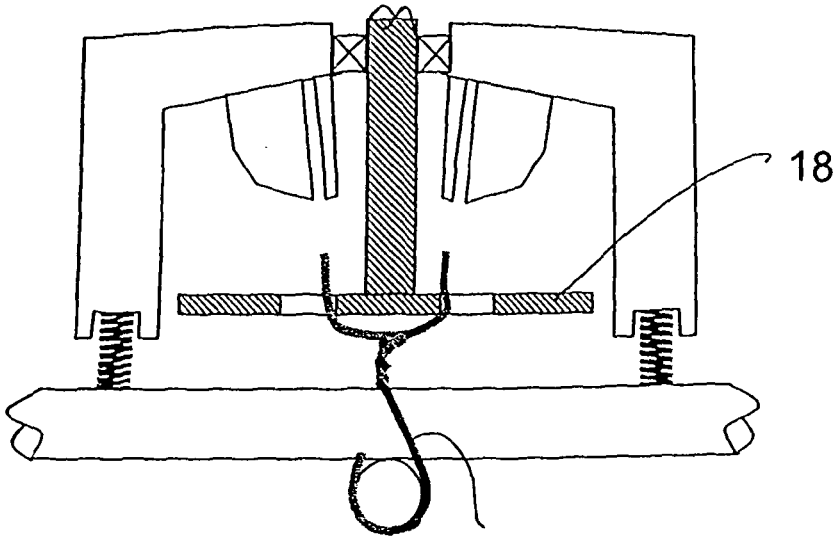
Figure 10:
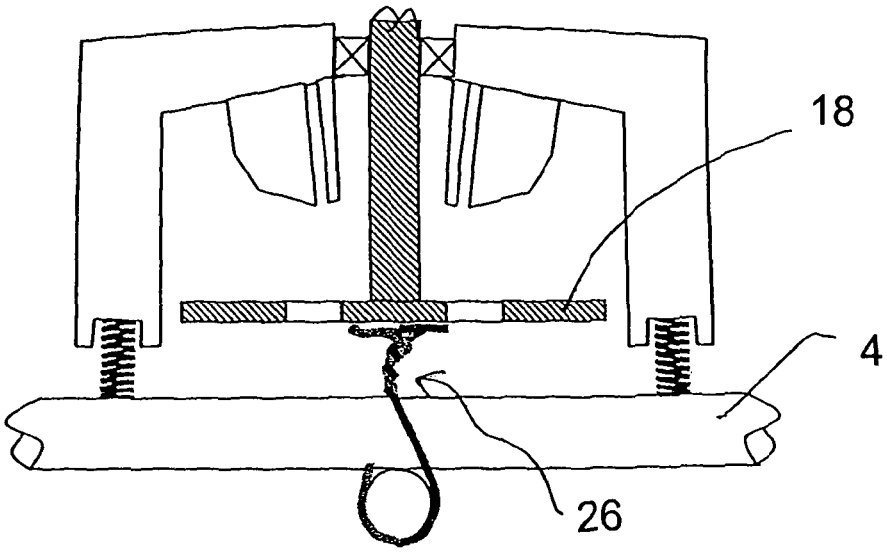

As FIGS. 9 and 10 show, the second stage of the tie in this case does not wrap around the first stage 26 but is rather formed above it. The tie plate 18 does result in the second stage being more or less flat as can be seen in the completed tie in FIG. 10.

Figure 11:
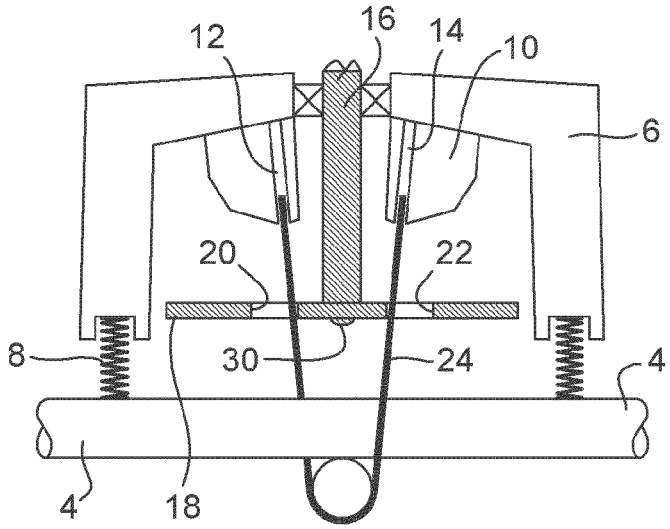
FIG. 11 is a view similar to FIG. 1 showing a machine according to a third embodiment.

FIG. 11 shows a third embodiment of the machine in which the center of the tie plate 18, which contacts the end of the tie, comprises a protrusion 30.

Figure 12:
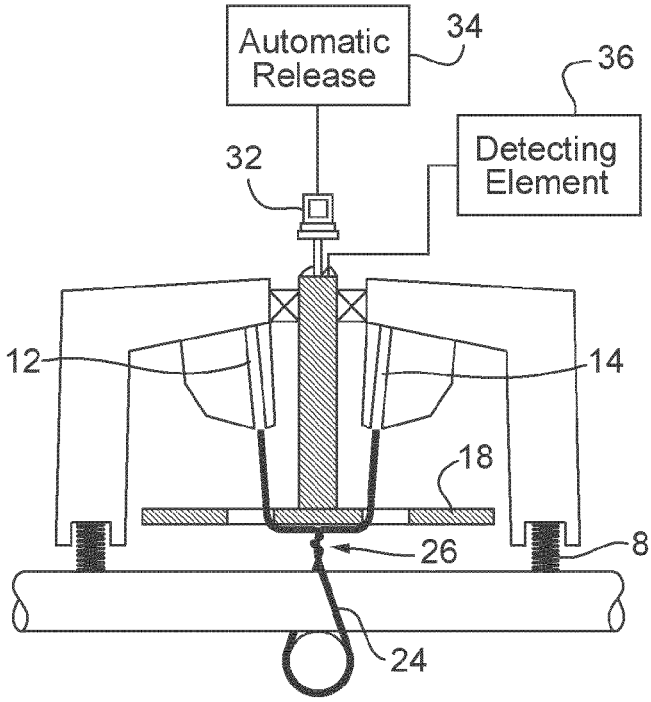
FIG. 12 is a view similar to FIG. 4 showing a machine according to a fourth embodiment.

FIG. 12 shows a fourth embodiment of the machine which comprises a ratchet latch 32. The ratchet latch 32 is linked to an automatic release 34 to automatically release the ratchet latch 32 at an appropriate point after the tie 26 is finished. The machine also comprises a detecting element 36 adapted to detect when the tie plate 18 has reached the end of its travel.

What is claimed is:

1. A machine for forming a two-stage wire tie around a pair of bars to bind the bars together, said machine comprising an arrangement for passing said wire in a loop around the bars and a twisting head for twisting the ends of said loop together, said twisting head comprising an arrangement for gripping the ends of the wire and a tie plate through which the ends of the wire pass, and said head being resiliently mounted relative to the bars so as to allow the tie plate to move through a predetermined amount of travel towards the bars, to thereby define the length of a first stage of the tie, the machine being adapted thereafter to release the ends of the wire and twist these to form a second stage of the tie, wherein the centre of the tie plate comprises one or more protrusions.

2. A machine as claimed in claim 1 wherein the centre of the tie plate is flat.

3. A machine as claimed in claim 1 comprising a latch to hold the tie plate at the end of its travel.

4. A machine for forming a two-stage wire tie around a pair of bars to bind the bars together, said machine comprising an arrangement for passing said wire in a loop around the bars and a twisting head for twisting the ends of said loop together, said twisting head comprising an arrangement for gripping the ends of the wire and a tie plate through which the ends of the wire pass, and said head being resiliently mounted relative to the bars so as to allow the tie plate to move through a predetermined amount of travel towards the bars, to thereby define the length of a first stage of the tie, the machine being adapted thereafter to release the ends of the wire and twist these to form a second stage of the tie, further comprising a latch to hold the tie plate at the end of its travel, wherein said latch is provided by a ratchet mechanism throughout some or all of the travel.

5. A machine as claimed in claim 4 comprising an arrangement for releasing the latch automatically after the tie is finished.

6. A machine as claimed in claim 1 wherein the arrangement for gripping the ends of the wire is adapted to clamp the wire securely.

7. A machine as claimed in claim 1 wherein the tie plate moves towards the bars by approximately 1 mm for each full rotation of the twisting head.

8. A machine as claimed in claim 1 configured to be placed on a reinforcement bar with the tie plate initially less than 20 mm away from the bar.

9. A machine as claimed in claim 1 configured to be placed on a reinforcement bar with the tie plate initially less than 15 mm away from the bar.

10. A machine as claimed in claim 1 wherein the twisting head comprises at least one clamping member.

11. A machine as claimed in claim 1 wherein the twisting head comprises two clamping members, one for each end of the wire.

12. A machine as claimed in claim 11 wherein the or each clamping member can apply a clamping force to clamp the wire securely when the tension in the wire is at least between 250 and 350 Newtons.

13. A machine as claimed in claim 1 adapted to detect when the tie plate has reached the end of its travel.

14. A machine for forming a two-stage wire tie around a pair of bars to bind the bars together, said machine comprising an arrangement for passing said wire in a loop around the bars and a twisting head for twisting the ends of said loop together, said twisting head comprising an arrangement for gripping the ends of the wire and a tie plate through which the ends of the wire pass, and said head being resiliently mounted relative to the bars so as to allow the tie plate to move through a predetermined amount of travel towards the bars to thereby define the length of a first stage of the tie, the machine being adapted thereafter to release the ends of the wire and twist these to form a second stage of the tie, wherein the second stage of the tie is configured to wrap around outside of the first stage of the tie.

15. A machine as claimed in claim 1, wherein the second stage of the tie is configured to form above the first stage of the tie.

* * * * *

UNITED STATES PATENT AND TRADEMARK OFFICE

CERTIFICATE OF CORRECTION

PATENT NO. : 8,844,434 B2
APPLICATION NO. : 13/320221
DATED : September 30, 2014
INVENTOR(S) : Graham Frank Barnes et al.

It is certified that error appears in the above-identified patent and that said Letters Patent is hereby corrected as shown below:

In the Claims

At Column 4, Line 30, Claim 5, change “claim 4” to --claim 3--.

At Column 4, Line 51, Claim 12, change “claim 11” to --claim 10--.

At Column 4, Line 65, Claim 14, change “bars” to --bars,--.

Signed and Sealed this
Thirtieth Day of June, 2015

Michelle K. Lee

Michelle K. Lee
*Director of the United States Patent and Trademark Office*